US008495799B2

(12) United States Patent
Dilo

(10) Patent No.: US 8,495,799 B2
(45) **Date of Patent: *Jul. 30, 2013**

(54) FLEECE LAYER

(75) Inventor: Johann Phillipp Dilo, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/353,643

(22) Filed: Jan. 19, 2012

(65) Prior Publication Data

US 2012/0180264 A1 Jul. 19, 2012

(30) Foreign Application Priority Data

Jan. 19, 2011 (EP) ..... 11151392

(51) Int. Cl.
*D01G 25/00* (2006.01)

(52) U.S. Cl.
USPC ..... 19/296; 19/163

(58) Field of Classification Search
USPC ..... 19/161.1, 163, 296, 302
See application file for complete search history.

(56) References Cited

U.S. PATENT DOCUMENTS

| | | | | |
|---|---|---|---|---|
| 3,877,628 | A * | 4/1975 | Asselin et al. | 226/113 |
| 6,085,391 | A * | 7/2000 | Schaffler | 19/163 |
| 6,195,844 | B1 | 3/2001 | Jourde et al. | |
| 7,690,086 | B2 * | 4/2010 | Dilo | 19/163 |
| 7,779,513 | B2 * | 8/2010 | Dilo | 19/163 |
| 7,810,218 | B2 * | 10/2010 | Dilo et al. | 19/163 |
| 2005/0193525 | A1 | 9/2005 | Leger | |
| 2005/0217077 | A1 * | 10/2005 | Bastian et al. | 19/161.1 |
| 2007/0175000 | A1 * | 8/2007 | Dilo et al. | 19/163 |
| 2008/0196207 | A1 * | 8/2008 | Dilo et al. | 19/163 |
| 2012/0180265 | A1 * | 7/2012 | Dilo | 19/296 |

FOREIGN PATENT DOCUMENTS

| | | | |
|---|---|---|---|
| EP | 1136600 | A1 | 9/2001 |
| WO | WO9405836 | A1 | 3/1994 |
| WO | WO02094697 | A1 | 11/2002 |
| WO | WO2010073221 | A2 | 7/2010 |

* cited by examiner

*Primary Examiner* — Shaun R Hurley
(74) *Attorney, Agent, or Firm* — Jansson Munger McKinley & Shape Ltd.

(57) ABSTRACT

The fleece layer for laying down a card web to form a fleece has a cross-lapping upper carriage, through which the card web is guided; a cross-lapping laying carriage, through which the card web coming from the upper carriage is guided and which serves to lay the card web down onto an output conveyor belt; and at least two card web conveyor belts for guiding the card web to the upper carriage and from there to the laying carriage. A cover belt is arranged to enclose the card web lying on the upper run of a first card web conveyor belt from above. The cover belt is smooth and is not moved when the card web is moved, thus serving as a stationary cover of the card web.

12 Claims, 4 Drawing Sheets

FLEECE LAYER

CROSS REFERENCE TO RELATED APPLICATION

This application claims priority based on European patent application EP 11 151 392.5, filed Jan. 19, 2011.

FIELD OF THE INVENTION

The present invention relates to a fleece layer for laying down a card web to form a fleece.

BACKGROUND OF THE INVENTION

Fleece layers are used to lay multiple layers of a card web, produced by a carding machine, as uniformly as possible on an output apron. The card web is usually guided first through an upper carriage and proceeds from there to a laying carriage, through the laying gap of which the card web is deposited onto the output apron. At least two card web conveyor belts are used to guide the card web through the fleece layer. The movements of the card web conveyor belts, of the upper carriage, and of the laying carriage are controlled so as to coordinate with each other.

Between the infeed area of the fleece layer and the upper carriage, it is advantageous for the card web not only to rest on a card web conveyor belt but also to be enclosed by a cover belt from above. This prevents the fibers from being blown away from the card web and thus ensures the uniformity of the laid fleece. Designs of this type are known from, for example, DE 195 43 623 A1, EP 1 136 600 A1, and EP 1 870 499 B1.

The disadvantage of the fleece layer designs indicated above is the complexity of the system used to guide the endless cover belt. This complexity requires a large number of components and considerable mechanical effort.

SUMMARY OF THE INVENTION

It is an object of the present invention to provide a fleece layer which, even though it has the simplest possible mechanical design between the infeed area of the fleece layer and the upper carriage, ensures the reliable guidance of the card web without the danger that fibers will be blown away and requires only minimal maintenance.

According to an aspect of the invention, the fleece layer for laying down a card web to form a fleece comprises a cross-lapping upper carriage, through which the card web is guided, and a cross-lapping laying carriage, through which the card web coming from the upper carriage is guided and which serves to lay the card web down onto an output conveyor belt. The fleece layer also comprises at least two card web conveyor belts for guiding the card web to the upper carriage and from there to the laying carriage, wherein a first endless card web conveyor belt, the upper run of which extends from an infeed area of the fleece layer to the upper carriage and serves as a support surface for the card web, is designed as a rough card web conveyor belt to carry the card web lying on it forward by friction. Above the upper run of the first card web conveyor belt, a cover belt is arranged to enclose from above the card web lying on the upper run of the first card web conveyor belt. The cover belt is smooth, is not moved when the card web is moved, and thus serves as a stationary cover of the card web.

With this design, a means of guiding and covering the card web between the infeed area of the fleece layer and the upper carriage is achieved in a simple and low-cost manner, and the fibers are effectively prevented from being blown away from the card web. Because of the small number of mechanical components and motors in the area of the cover belt, this solution offers at the same time a considerable reduction in maintenance costs.

The cover belt is preferably designed to be impermeable to air to ensure that the card web is reliably covered and guided by the cover belt.

To obtain a surface which is as smooth and resistant as possible, the cover belt is preferably formed out of a Teflon-coated or PVC-coated fabric substrate.

If an air-impermeable cover belt is used, it is especially advantageous for the first card web conveyor belt to be permeable to air. In this way, the air carried along by the card web can effectively escape in a downward direction, and the blowing-away of fibers from the card web is prevented.

The cover belt is preferably supported in a machine stand of the fleece layer by extendible support means. This creates a certain capacity to compensate for possible changes in the position of the cover belt.

The extendible support means may preferably be springs or pneumatic cylinders.

In a preferred embodiment, the cover belt passes through the upper carriage. In this way, regardless of the position of the upper carriage at any one moment, the card web will always be reliably covered by the cover belt in the section between the infeed area of the fleece layer and the upper carriage. The upper carriage can thus slide through under the cover belt, and at each moment a different section of the cover belt is located within the upper carriage, regardless of the position which the upper carriage is occupying.

The guidance of the cover belt in the upper carriage is preferably optimized by arranging a guide element in the upper carriage to guide the cover belt.

To compensate for fluctuations in the speed of the card web which may occur upstream of the fleece layer, i.e., fluctuations which usually result from an intentional stretching of the card web, the fleece layer can comprise, in its infeed area, a vertically movable pressing roll to form a card web buffer.

The pressing roll can preferably be moved in such a way that it presses down from above onto the cover belt and thus onto the upper run of the first card web conveyor belt. In this way, it is possible to increase the distance traveled by the card web in the infeed area of the fleece layer, which compensates for an increase in the infeed speed of the card web.

A mechanically preferred solution for the formation of the card web buffer is for the pressing roll to press down onto a slanted infeed section of the cover belt and of the first card web conveyor belt.

In a preferred embodiment, during the time that the card web buffer is formed, the increase in the distance spanned by the cover belt is compensated by the extendible support means which support the cover belt in the fleece layer. A movable tension carriage, through which the first card web conveyor belt passes, is preferably provided to compensate for the additional length of the first card web conveyor belt required for the card web buffer. This tension carriage can be controlled in an open-loop or closed-loop manner in correspondence with the required additional length of the first card web conveyor belt and thus ensures the necessary compensation, so that the overall length of the first card web conveyor belt remains unchanged.

BRIEF DESCRIPTION OF THE DRAWINGS

Additional features and advantages of the present invention can be derived from the following description, which refers to the drawings.

DETAILED DESCRIPTION OF THE INVENTION

Figure 1:
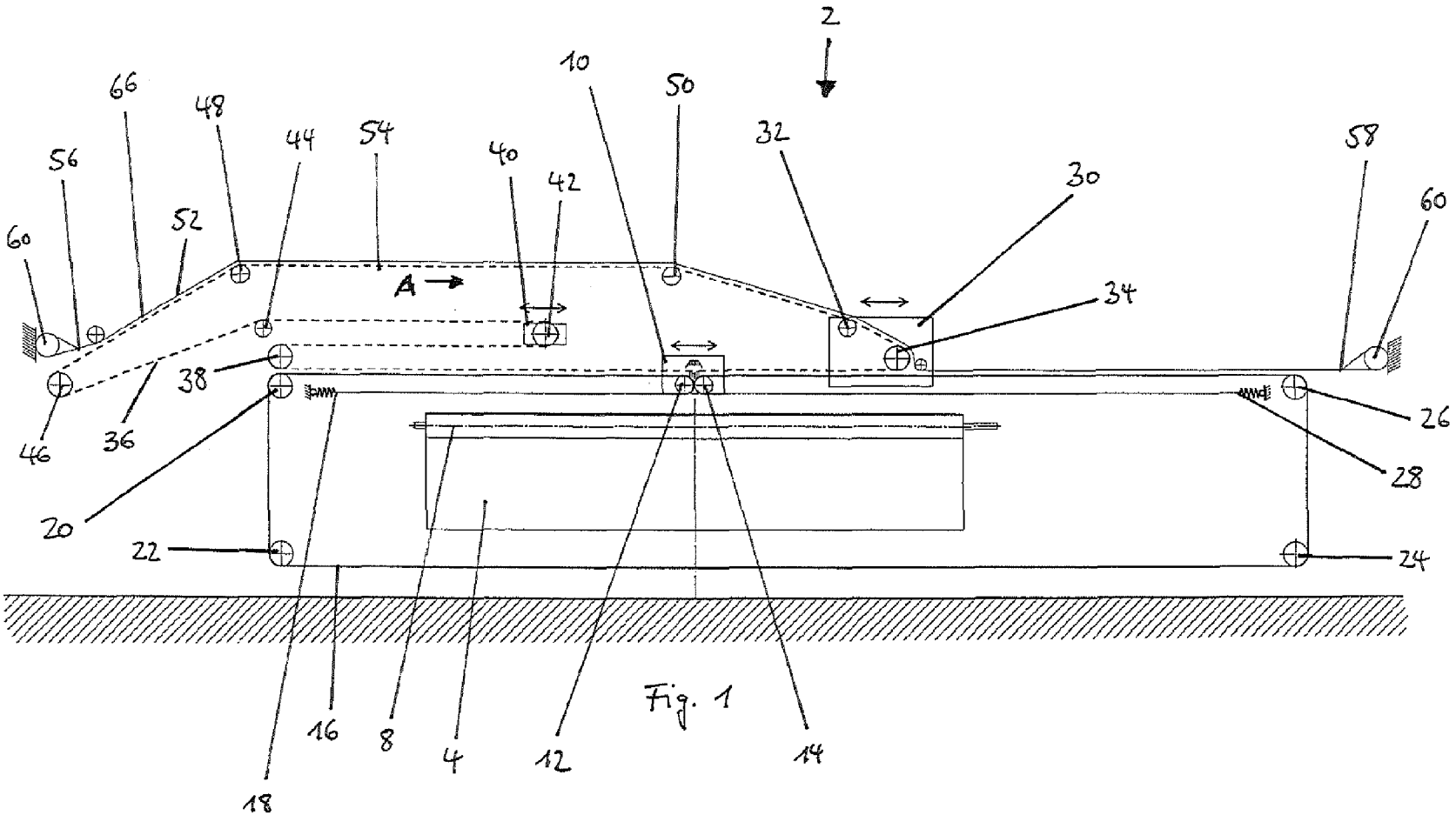
FIG. 1 is a schematic, cross-sectional view of a preferred embodiment of a fleece layer according to the invention.

FIG. 1 is a schematic cross-sectional view of a preferred embodiment of the invention. In FIG. 1 the fleece layer 2 with its endless output conveyor belt 4 (apron) is shown, which is intended to carry away the fleece produced from a card web 6 (see FIG. 2) in a transport direction perpendicular to the plane of the drawing. An upper deflecting roll 8, which represents one of the guide devices of output conveyor belt 4, is shown. For the sake of clarity, the card web 6 is shown only in FIG. 2.

A laying carriage 10 can be moved back and forth on rails or pipes (not shown) above output conveyor belt 4. Two freely rotatable deflecting rolls 12 and 14 are supported in laying carriage 10. A card web conveyor belt 16, also called the "second card web conveyor belt 16" below, wraps part of the way around the first deflecting roll 12. At its first end 18, second card web conveyor belt 16 is permanently connected to the machine stand (not shown) of fleece layer 2 and extends from there above and only a short distance away from output conveyor belt 4 until it reaches laying carriage 10, where it reverses direction by 180° and is then guided back over four stationary deflecting rolls 20, 22, 24, 26 before arriving back at second deflecting roll 14 in the laying carriage. Second card web conveyor belt 16 wraps part of the way around deflecting roll 14, which is also supported in freely rotatable fashion in laying carriage 10. Card web conveyor belt 16 thus reverses its direction here by 180° and then proceeds from the lower outlet area of laying carriage 10, passing only a short distance above output conveyor belt 4, to the machine stand of fleece layer 2, to which its second end 28 is also permanently attached.

On laying carriage 10, a chain or a toothed belt is mounted, which passes, for example, over a drive gear wheel connected to a motor and a deflecting roll (none of these elements is shown). By means of these drive devices, laying carriage 10 can be moved back and forth above the output conveyor belt 4 crosswise to the transport direction of the belt (i.e., in transverse directions).

At about the same height as laying carriage 10, an upper carriage 30 is supported on rails or pipes (not shown) in the machine stand of fleece layer 2 so that it can move crosswise to the transport direction of the output conveyor belt 4 (i.e., in transverse directions). The rails or pipes can be the same rails or pipes as those on which laying carriage 10 is also movably supported. Upper carriage 30 has an upper deflecting roll 32 and a lower deflecting roll 34, which are offset laterally from each other. Another card web conveyor belt 36, called the "first card web conveyor belt 36", passes over these two deflecting rolls 32, 34. In the area bounded by two deflecting rolls 32, 34 in the upper carriage, the first card web conveyor belt 36 passes downwards at a slant.

Proceeding from lower deflecting roll 34 in upper carriage 30, first card web conveyor belt 36 extends parallel to the right upper run of second card web conveyor belt 16. First card web conveyor belt 36 extends in a straight line through laying carriage 10, and, after leaving laying carriage 10, it passes over a stationary, motor-driven deflecting roll 38. From there, it is guided over a deflecting roll 42 supported in a tension carriage 40 and then proceeds over several stationary deflecting rolls 44, 46, 48, 50 supported in the machine stand (not shown) of the fleece layer 2 before reaching upper carriage 30 again. Upper carriage 30 and tension carriage 40 can be connected to each other by a chain or a toothed belt (not shown), which passes over a drive gear wheel connected to a motor (not shown) and a deflecting pulley, which are mounted in the machine stand. Tension carriage 40 is also supported on rails or pipes (not shown), so that it can move back and forth. It can also be advantageous for the movements of the upper carriage and those of tension carriage 40 to be isolated from each other.

In the area between lower deflecting roll 34 of upper carriage 30 and second deflecting roll 14 of laying carriage 10, sections of first card web conveyor belt 36 and of second card web conveyor belt 16 are guided parallel to and only a short distance away from each other, so that a card web 6 supplied by first card web conveyor belt 36 is sandwiched between first card web conveyor belt 36 and second card web conveyor belt 16 in the just-mentioned area between upper carriage 30 and laying carriage 10. Card web 6 is supported on second card web conveyor belt 16. In addition, the two sections of second card web conveyor belt 16 extending between laying carriage 10 and the machine stand of fleece layer 2 simultaneously serve as a cover belt thr the deposited fleece.

It can be seen in FIG. 1 that the upper carriage 30 and its associated tension carriage 40 move in opposite directions during operation. Tension carriage 40 serves to keep the length of the loop of first card web conveyor belt 36 constant.

The movements of laying carriage 10 and of upper carriage 30 are coordinated with each other in such a way that, as card web 6 is being supplied at uniform speed to fleece layer 2, card web 6 can be deposited in a controlled manner on output conveyor belt 4 without any stretching or squeezing within fleece layer 2. Upper carriage 30 travels in the same direction as laying carriage 10 but on average only half as fast. Account is also taken of the fact that laying carriage 10 is braked to a stop in the area where it reverses direction and then must be accelerated again. If card web 6 is supplied at fluctuating speeds, perhaps because a web drafter (not shown) working in cycles is installed upstream of fleece layer 2 so that alternating thicknesses can be produced in card web 6 for the purpose of achieving a transverse profiling of the laid fleece, a variable card web buffer can be used in fleece layer 2 to buffer the card web within fleece layer 2.

A gap, called the laying gap, is formed between two deflecting rolls 12 and 14 in laying carriage 10. During the operation of fleece layer 2, two card web conveyor belts 16, 36 are driven in such a way that they travel at the same speed.

Fleece layer 2 comprises a cover belt 52, which extends from the infeed area of fleece layer 2 at least as far as upper carriage 30. Cover belt 52 lies directly above the upper run 54 of first card web conveyor belt 36, which serves in this area as a support surface for card web 6 and which moves in the direction of the arrow A. Card web 6 is thus enclosed between the upper run 54 of first card web conveyor belt 36 and cover belt 52. Whereas first card web conveyor belt 36 has a rough surface and is preferably designed as an air-permeable screen belt, cover belt 52 has a smooth surface and is substantially stationary in fleece layer 2. Cover belt 52 is preferably impermeable to air and made out of, for example, Teflon-coated or PVC-coated fabric. It is also possible for first card web conveyor belt 36 to be impermeable to air, whereas stationary cover belt 52 has pores to allow air to escape but is not rough.

The endless first card web conveyor belt 36 carries card web 6 lying on it forward by friction, and cover belt 52, which does not move along with card web 6, serves as a stationary cover and thus prevents the fibers of card web 6 from being whirled up or blown away in an undesirable manner. Card web 6 thus remains free of turbulence for the most part, which allows higher web line speeds to be achieved. In other words, card web 6 is guided in a sandwich-like manner between upper run 54 of first card web conveyor belt 36 and cover belt 52, wherein it is moved forward exclusively by the movement of first card web conveyor belt 36. Smooth cover belt 52 offers no obstacle to the movement of card web 6.

Cover belt 52 does not necessarily have to cover entire upper run 54 of first card web conveyor belt 36, but it preferably extends from the infeed area of fleece layer 2 all the way through upper carriage 30. Cover belt 52 is preferably attached at both ends to the machine stand of fleece layer 2. Cover belt 52 will thus proceed from a first attachment point 56 in the infeed area of fleece layer 2, follow the path of first card web conveyor belt 36 all the way to upper carriage 30, pass through upper carriage 30, and then proceed from upper carriage 30 horizontally to second attachment point 58 at the rear of fleece layer 2. In the area of the attachment points 56, 58, cover belt 52 is preferably supported in the machine stand by extendible support means 60. Extendible support means 60 can be either springs or pneumatic cylinders or other suitable elements.

Figure 2:
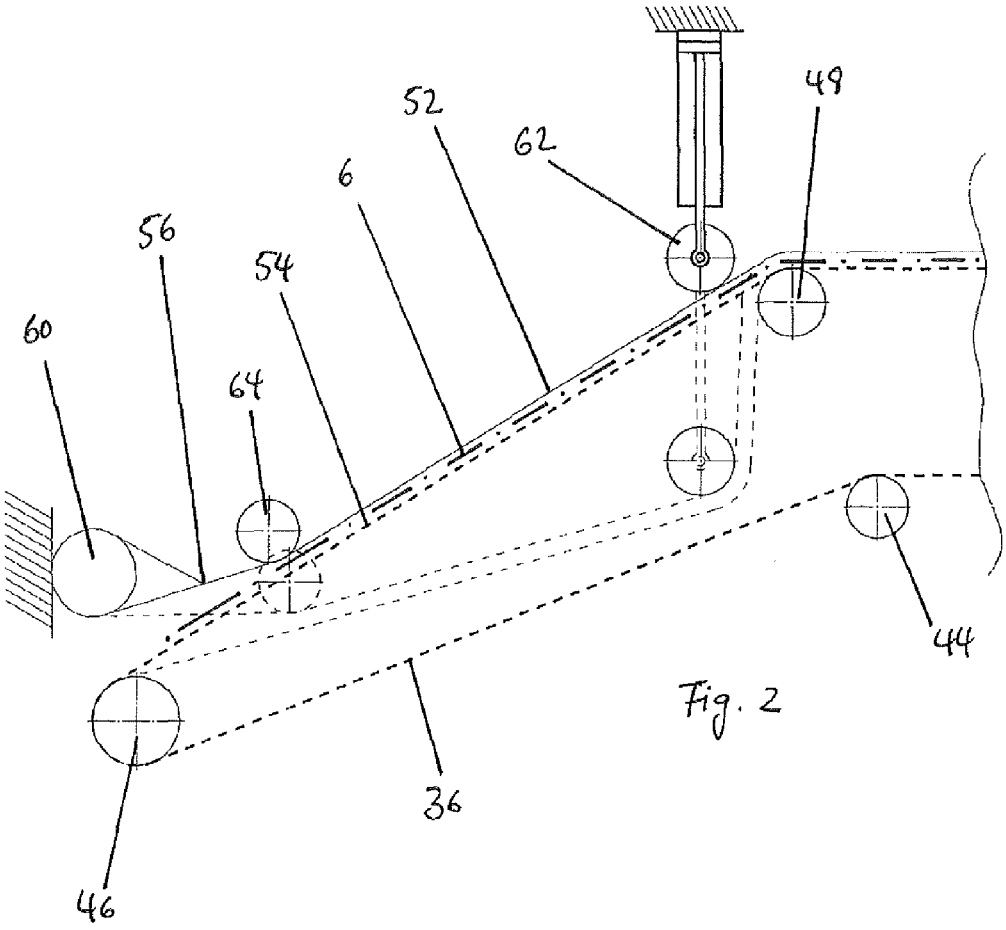
FIG. 2 is a schematic cross-sectional view of a preferred way of forming a card web buffer in the infeed area of the fleece layer.

In the advantageous embodiment shown in FIG. 2, fleece layer 2 can also comprise, in its infeed area, a vertically movable pressing roll 62, which serves to form a card web buffer in fleece layer 2. Pressing roll 62 can be moved in such a way that it presses down from above onto cover belt 52 and thus simultaneously onto upper run 54 of first card web conveyor belt 36. This movement can be assisted by a support roll 64, which is also arranged in the infeed area of fleece layer 2 and which also presses down from above onto cover belt 52. To ensure that the distance which card web 6 travels when pressing roll 62 is lowered is increased in a defined manner, deflecting roll 48 can be used in conjunction with deflecting roll 46 as a tensioning means. The increased distance which card web 6 travels will then extend substantially vertically between lowered pressing roll 62 and deflecting roll 48, as can be seen from the diagram of loop formation shown in broken line in FIG. 2. In the especially preferred embodiment shown here, pressing roll 62 presses down on the slanted infeed section 66 of cover belt 52 and thus also of first card web conveyor belt 36.

To compensate for the additional length of cover belt 52 required in the card web buffer, extendible support means 60 are provided, by means of which the mounting of cover belt 52 at its two ends can be extended. Because first card web conveyor belt 36 moves, the situation is different for it. To compensate for the additional length of first card web conveyor belt 36 required in the card web buffer, tension carriage 40, for example, can be actuated in a correspondingly different way, possibly by means of an automatic control circuit. In the preferred embodiment shown here, tension carriage 40 (see FIG. 1) can, by moving toward the left, provide the additional length of first card web conveyor belt 36 required for the card web buffer while simultaneously leaving the overall length of first card web conveyor belt 36 unchanged. It is also possible to conceive of other methods of compensation operating within the closed loop of first card web conveyor belt 36.

This card web buffer makes it possible to compensate for the previously mentioned differences in the speed of incoming card web 6 without the need to make the movements of upper carriage 30 or of laying carriage 10 different from the movements executed during normal operation.

Figure 3:
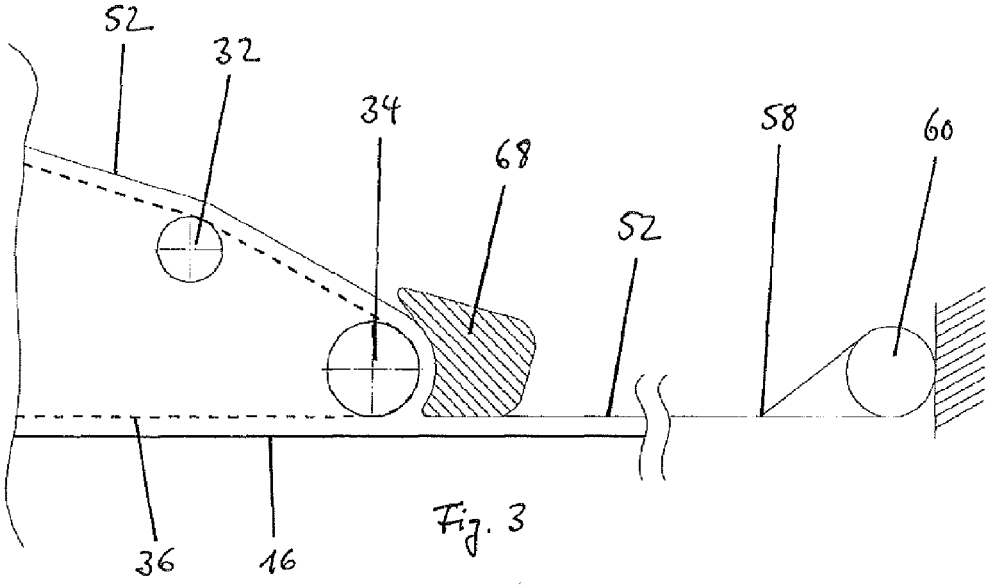
FIG. 3 is a schematic cross-sectional view of a preferred way of guiding the cover belt in the area of the upper carriage.

FIG. 3 shows one preferred embodiment of guiding cover belt 52 in upper carriage 30. Due to the back-and-forth travel of upper carriage 30, stationary cover belt 52 must be supported on both the left and right so that, when upper carriage 30 moves, cover belt 52 can slide through it in a defined manner. For this purpose, an additional guide element 68 is required; in the present example, this is a guide shoe, which must be as smooth as possible. It is located opposite and directly adjacent to lower deflecting roll 34 of upper carriage 30.

Figure 4:
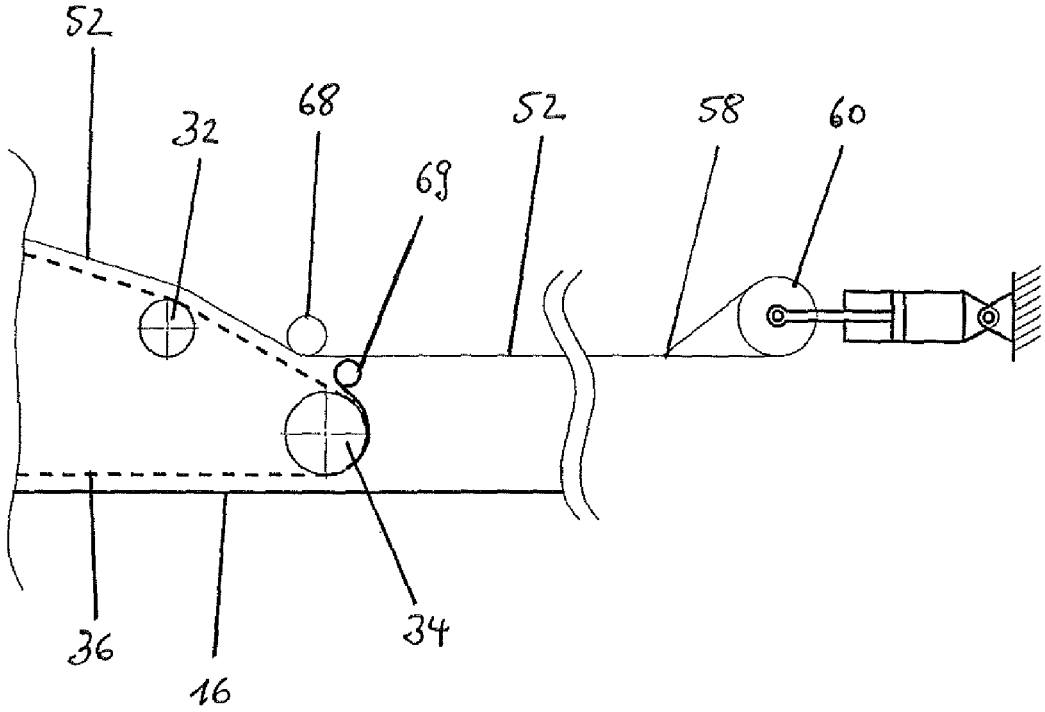
FIG. 4 is a schematic cross-sectional view of another preferred way of guiding the cover belt in the area of the upper carriage.

FIG. 4 shows an alternative preferred embodiment for guiding cover belt 52 in upper carriage 30. Here guide element 68 is designed as a smooth roll, which is carried along with upper carriage 30. This guide roll is arranged above lower deflecting roll 34, and cover belt 52 is deflected around it. In a case such as this, it is advantageous with respect to the guidance of the card web around lower deflecting roll 34 to provide an additional guide means 69, such as the guide means known from US 20080256756 A1.

Figure 5:
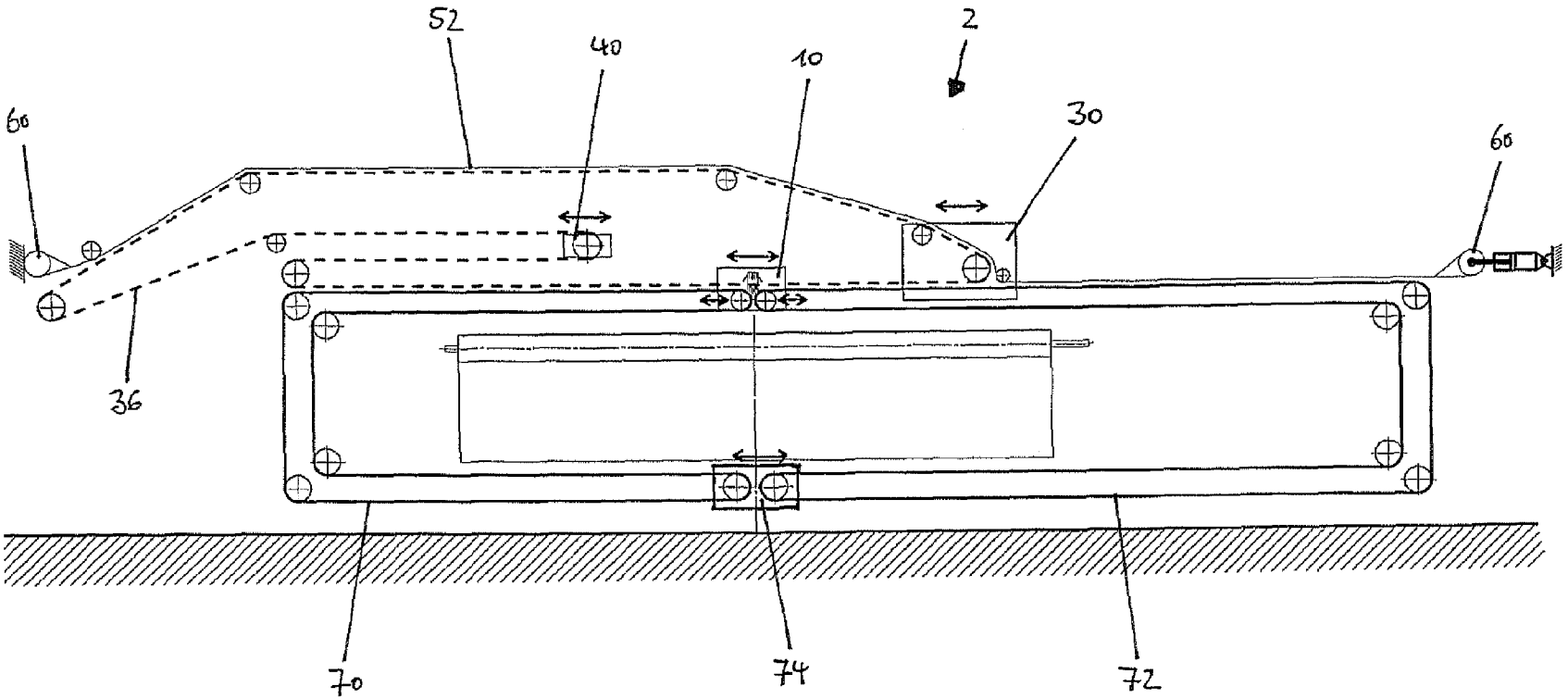
FIG. 5 is a schematic cross-sectional view of an alternative preferred embodiment of a fleece layer according to the invention.

As described above, fleece layer 2 contains a total of two card web conveyor belts 16, 36. The invention can also be applied to other types of fleece layers with two card web conveyor belts and also to all other types of fleece layers, including those with three belts. One preferred embodiment of such a fleece layer with three card web conveyor belts is shown in FIG. 5. In the case of the fleece layer shown in FIG. 5, second card web conveyor belt 16 of the embodiment according to FIG. 1 is replaced by a second card web conveyor belt 70 and a third card web conveyor belt 72, which are deflected inside a common tension carriage 74.

The invention is also applicable to opposite-motion fleece layers, in which upper carriage 30 and laying carriage 10 move in opposite directions, and also to camel-back fleece layers.

Reference throughout this specification to "one embodiment," "an embodiment," "a preferred embodiment," "alternate embodiment" or similar language means that a particular feature, structure, or characteristic described in connection with the embodiment is included in at least one embodiment of the present invention. Thus, appearances of the phrases "in one embodiment," "in an embodiment," "in a preferred embodiment," "in an alternate embodiment," and similar language throughout this specification may, but do not necessarily, all refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

While the present invention has been described in connection with certain preferred, exemplary, alternate or specific embodiments, it is to be understood that the invention is not limited to the disclosed embodiments, but, on the contrary, is intended to cover various modifications, alternatives, modifications and equivalent arrangements as will be apparent to those skilled in the art. Any such changes, modifications, alternatives, modifications, equivalents and the like may be made without departing from the spirit and scope of the invention.

What is claimed is:

1. A fleece layer for laying down a card web to form a fleece, comprising:

an upper carriage, which is movable back and forth in transverse directions and through which the card web is guided;

a laying carriage, which is movable back and forth in the transverse directions and through which the card web coming from the upper carriage is guided, the laying carriage serving to lay the card web down onto an output conveyor belt;

at least two card web conveyor belts for guiding the card web to the upper carriage and from there to the laying carriage, wherein a first endless card web conveyor belt, an upper run of which extends from an infeed area of the fleece layer to the upper carriage and serves as a support surface for the card web, is designed as a rough card web conveyor belt and carries the card web lying on it forward by friction, and wherein a cover belt is arranged above the upper run of the first card web conveyor belt to enclose the card web lying on the upper run of the first card web conveyor belt from above, wherein the cover belt is smooth and is not moved when the card web is moved by the first endless card web conveyor belt, the cover belt thus serving as a stationary cover of the card web.

2. The fleece layer of claim 1, wherein the cover belt is impermeable to air.

3. The fleece layer of claim 1, wherein the cover belt is a Teflon-coated or PVC-coated fabric belt.

4. The fleece layer of claim 1, wherein the first card web conveyor belt is permeable to air.

5. The fleece layer of claim 1, wherein the cover belt is supported in a machine stand of the fleece layer by extendible support means.

6. The fleece layer of claim 5, wherein the extendible support means are springs or pneumatic cylinders.

7. The fleece layer of claim 1, wherein the cover belt passes through the upper carriage.

8. The fleece layer of claim 7, wherein a guide element for guiding the cover belt is arranged in the upper carriage.

9. The fleece layer of claim 5, further comprising in the infeed area a vertically movable pressing roll to form a card web buffer.

10. The fleece layer of claim 9, wherein the pressing roll is movable in such a way that it presses down from above onto the cover belt and thus also onto the upper run of the first card web conveyor belt.

11. The fleece layer of claim 10, wherein the pressing roll is movable in such a way that it presses down onto a slanted infeed section of the cover belt and of the first card web conveyor belt.

12. The fleece layer of claim 9, wherein a movable tension carriage is provided, through which the first card web conveyor belt passes and the movement of which is controlled in an open-loop or closed-loop fashion to compensate for an additional length of the first card web conveyor belt required for the card web buffer.

* * * * *